US010568366B1

(12) United States Patent
Cavosie

(10) Patent No.: US 10,568,366 B1
(45) Date of Patent: Feb. 25, 2020

(54) WIRELESS BRASSIERE WITH SUPPORT SYSTEM

(71) Applicant: TRISTAR PRODUCTS, INC., Fairfield, NJ (US)

(72) Inventor: Tara J. Cavosie, Loudonville, NY (US)

(73) Assignee: TRISTAR PRODUCTS, INC., Fairfield, NJ (US)

( * ) Notice: Subject to any disclaimer, the term of this patent is extended or adjusted under 35 U.S.C. 154(b) by 0 days.

(21) Appl. No.: 16/574,862

(22) Filed: Sep. 18, 2019

Related U.S. Application Data

(60) Provisional application No. 62/858,205, filed on Jun. 6, 2019.

(51) Int. Cl.
*A41C 3/00* (2006.01)

(52) U.S. Cl.
CPC ..... *A41C 3/0028* (2013.01)

(58) Field of Classification Search
CPC .... A41C 1/06; A41C 1/08; A41C 3/08; A41C 3/0057; A41C 3/0092; A41C 3/0028
USPC ..... 450/86, 30–33
See application file for complete search history.

(56) References Cited

U.S. PATENT DOCUMENTS 1,891,610 A * 12/1932 Schiaparelli ..... A41D 7/00 450/32
5,873,767 A * 2/1999 Pickett ..... A41C 3/00 2/73
8,403,724 B1 * 3/2013 Chapin ..... A41D 10/00 2/106
8,545,287 B2 * 10/2013 Campbell ..... A41C 3/0021 450/30
2006/0019577 A1 * 1/2006 Gransberry ..... A41F 15/002 450/86
2007/0004314 A1 * 1/2007 Carlucci ..... A41C 3/148 450/30
2010/0298914 A1 * 11/2010 Rosenbaum ..... A61F 7/00 607/108
2011/0244757 A1 * 10/2011 Mays ..... A41C 3/0021 450/31
2011/0269376 A1 * 11/2011 Clim ..... A41F 15/00 450/86
2019/0116891 A1 * 4/2019 Wisniewski ..... A41C 3/0028

* cited by examiner

*Primary Examiner* — Gloria M Hale
(74) *Attorney, Agent, or Firm* — Johnson, Marcou, Isaacs & Nix, LLC; John M. Harrington, Esq.

(57) ABSTRACT

A wireless brassiere with built-in shaping, lifting, and support system and methods includes, for example, a support band, an exterior support layer having lower edge portions connected to the support band and also having portions defining two cup-like shapes, an interior support layer having portions defining two breast cups and configured to be positioned between a front portion of the exterior support layer and the front of the torso of a wearer and also having lower edge portions connected to the support band. Interior support layer shoulder straps having adjustable lengths extend between the interior support layer and the rear portion of the exterior support layer, and the interior support layer and interior support layer shoulder straps are independently moveable relative to the exterior support layer.

25 Claims, 10 Drawing Sheets

WIRELESS BRASSIERE WITH SUPPORT SYSTEM

PRIORITY APPLICATION

This application claims priority to U.S. Provisional Application No. 62/858,205 filed Jun. 6, 2019, entitled "WIRELESS BRASSIERE WITH BUILT-IN SHAPING, LIFTING, AND SUPPORT SYSTEM", which is incorporated herein by this reference.

FIELD OF THE INVENTION

The present invention relates generally to brassieres, and more particularly to a wireless brassiere having a support system and methods of making and using same.

BACKGROUND OF HE INVENTION

Most brassieres currently on the market are made up of various components, such as a frame, straps, cups, underwires, side wings, a back band, a center bridge, and clasps, that are sewn together as one garment and do not have the ability to move freely with regard to one another, or, in the case of wireless comfort bras, are constructed as one continuous piece of fabric. It is difficult to address the many needs of a wearer's breasts with such currently available garments which are constructed and function as a single unit, because the wearer's breasts have different needs that must be addressed individually.

Thus, there is a current need for an improved brassiere having multiple layers that shape, lift and support a wearer's breasts.

SUMMARY OF THE INVENTION

Figure 1:
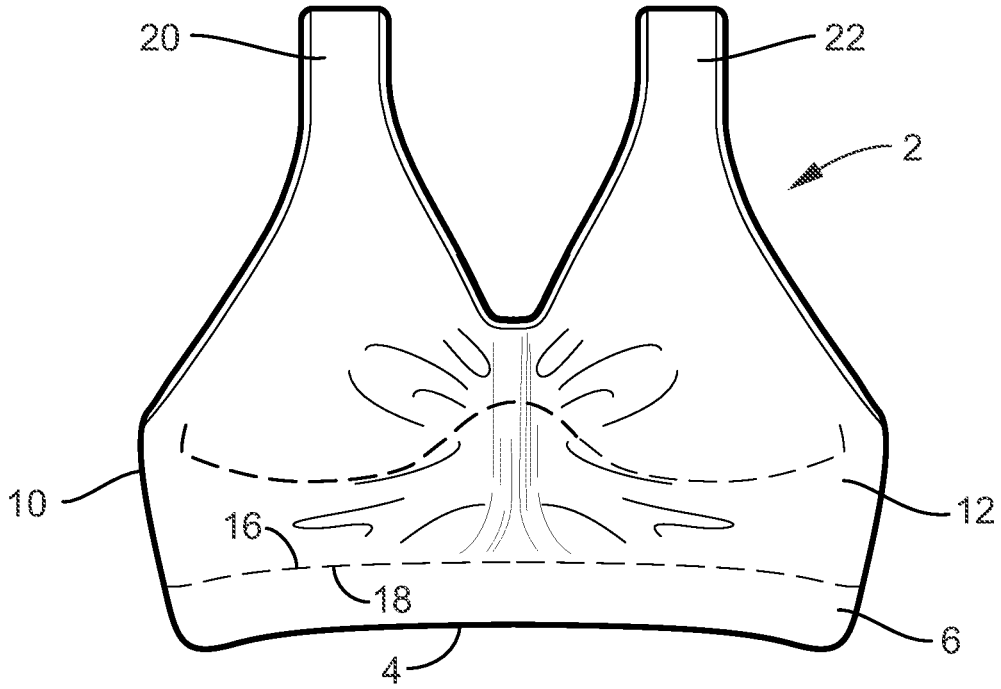
FIG. 1 illustrates a front view of an example of a brassiere according to embodiments of the invention.

Embodiments of the invention provide a wireless brassiere with built-in shaping, lifting, and support system that may include, for example, a brassiere support band configured to be positioned along a front of the torso and a support band rear portion configured to be positioned at a back of the torso.

In addition, the brassiere according to embodiments of the invention may include, for example, an exterior support layer configured be positioned at a front of the torso and an exterior support layer rear portion configured to be positioned at the back of the torso, wherein the exterior support layer comprises an exterior support layer lower edge portion connected to the support band, and an exterior support layer shoulder strap extending between the exterior support layer rear portion and the exterior support layer front portion.

Further, the brassiere according to embodiments of the invention may include, for example, an interior support layer configured to be positioned between the exterior support layer front portion and the front of the torso of the wearer, wherein the interior support layer comprises an interior support layer lower edge portion connected to the support band front portion; and an interior support layer shoulder strap extending between an upper edge portion of the exterior support layer rear portion and an upper edge portion of the interior support layer.

In an aspect of the brassiere according to embodiments of the invention, the support band may include, for example, an elastic material. In further aspects, the support band may include, for example, an elastic material selected from a group consisting of a blended or knitted fabric material, a woven elastic material, a nylon material, a spandex material, or a cotton material. In still further aspects, the exterior support layer front portion may include, for example, a material having portions defining two cup-like shapes. In additional aspects, the exterior support layer front portion may include, for example, a fabric material having portions defining the two cup-like shapes. In another aspect, the brassiere does not have an underwire for supporting the wearer's breasts.

In other aspects of the brassiere according to embodiments of the invention, the exterior support layer rear portion may include, for example, a back closure. In further aspects, the exterior support layer lower edge portion may be connected, for example, to an upper edge portion of the support band. In still further aspects, an entire length of a lower edge of the exterior support layer may be connected, for example, to an entire length of an upper edge of the support band.

In additional aspects of the brassiere according to embodiments of the invention, the interior support layer may include, for example, a material having portions defining two cup-like shapes. In additional aspects, the interior support layer may include, for example, a fabric material having portions defining the two cup-like shapes. In other aspects, the interior support layer may include, for example, a molded material having portions defining the two cup-like shapes.

In still other aspects of the brassiere according to embodiments of the invention, the interior support layer may include, for example, the molded material having portions defining the two cup-like shapes disposed adjacent two cup-like shapes defined in a material of the exterior support layer front portion. In further aspects, the interior support layer may include, for example, the molded material having portions defining two breast cups disposed adjacent the two cup-like shapes defined in a material of the exterior support layer front portion. It is to be understood that the interior and exterior support layers may each have portions defining two cup-like shapes.

In still further aspects of the brassiere according to embodiments of the invention, the interior support layer lower edge portion may be connected, for example, to the support band front portion, and the exterior support layer lower edge portion may be connected, for example, to the support band independently of one another and independently movable relative to one another.

In other aspects of the brassiere according to embodiments of the invention, the interior support layer shoulder straps may include, for example, interior support layer shoulder straps having adjustable lengths. In additional aspects, the interior support layer shoulder straps may, for example, be independently moveable relative to the exterior support layer. In still other aspects, the interior support layer shoulder straps may, for example, be at least partly concealed within channels formed on portions of the exterior support layer shoulder straps. In further aspects, the interior support layer shoulder straps may, for example, be configured to be connected to the upper edge portion of the exterior support layer rear portion at positions lying in a same horizontal plane as a midline of respective breasts of the torso of the wearer.

Embodiments of the invention may also include a method of making a wireless brassiere with built-in shaping, lifting, and support system involving, for example, providing a support band configured to at least partially encircle a torso of a wearer, which support band has a support band front portion configured to be positioned along a front of the torso and a support band rear portion configured to be positioned along a back of the torso.

According to embodiments of the invention, the method of making the wireless brassiere may further involve, for example, attaching an exterior support layer to the support band at lower edge portion of the exterior support layer, which exterior support layer is configured to at least partially encircle the torso and has an exterior support layer front portion configured to be positioned at a front of the torso and an exterior support layer rear portion configured to be positioned at a back of the torso, and exterior support layer shoulder straps extending between the exterior support layer rear portion and the exterior support layer front portion.

According to embodiments of the invention, the method of making the wireless brassiere may also involve, for example, attaching an interior support layer a at lower edge portion of the interior support layer to the support band front portion, which interior support layer is configured to be positioned between the exterior support layer front portion and the front of the torso of the wearer; and connecting an interior support layer shoulder strap between an upper edge portion of the exterior support layer rear portion and an upper edge portion of the interior support layer.

An aspect of the method of making the wireless brassiere according to embodiments of the invention may involve, for example, attaching the exterior support layer to the support band at the lower edge portion of the exterior support layer and attaching the interior support layer at the lower edge portion of the interior support layer to the support band front portion, wherein the exterior support layer and the interior support layer are attached independently of one another and are independently movable relative to one another. Another aspect may involve, for example, connecting the interior support layer shoulder strap between the upper edge portion of the exterior support layer rear portion and the upper edge portion of the interior support layer, wherein the interior support layer shoulder strap has an adjustable length.

Another aspect of the method of making the wireless brassiere according to embodiments of the invention may involve, for example, connecting the interior support layer shoulder strap between the upper edge portion of the exterior support layer rear portion and the upper edge portion of the interior support layer, wherein the interior support layer is independently moveable relative to the exterior support layer. A further aspect may involve, for example, connecting the interior support layer shoulder strap between the upper edge portion of the exterior support layer rear portion and the upper edge portion of the interior support layer at least partly concealed within a channel formed on the exterior support layer shoulder strap.

A further aspect of the method of making the wireless brassiere according to embodiments of the invention may involve, for example, connecting the interior support layer shoulder strap between the upper edge portion of the interior support layer and the upper edge portion of the exterior support layer rear portion at a location on the upper edge portion of the interior support layer rear portion configured to be in a same horizontal plane as a midline or center line of respective breasts of the torso of the wearer.

Embodiments of the invention may additionally include a method of adjusting a wireless brassiere with built-in shaping, lifting, and support system, which brassiere includes, for example, a support band, an exterior support layer having a lower edge portion of the exterior support layer connected to the support band and an exterior support layer shoulder strap extending between a rear portion of the exterior support layer and a front portion of the exterior support layer, the front portion of the exterior support layer having portions defining two cup-like shapes. Such brassiere may also include, for example, an interior support layer having portions defining two breast cups and configured to be positioned between the front portion of the exterior support layer and the front of the torso of the wearer, a lower edge portion of the interior support layer being connected to the support band, and an interior support layer shoulder strap having an adjustable length extending between the interior support layer and the rear portion of the exterior support layer and independently moveable relative to the exterior support layer.

The method of adjusting the brassiere according to embodiments of the invention may involve, for example, placing the brassiere on the torso of a wearer with the wearer's breasts received within the two breast cups defined by the portions of the interior support layer; and altering a tension of the interior support layer shoulder strap on said wearer by adjusting a length of said interior support layer shoulder strap independently of said exterior support layer.

These and other aspects of embodiments of the invention are set forth in the description which follows and in part will become more apparent to those skilled in the art upon examination of the following or may be learned from practice of embodiments of the invention. It is intended that all such aspects are to be included within this description, are to be within the scope of the present invention, and are to be protected by the accompanying claims.

DETAILED DESCRIPTION

Reference will now be made in detail to embodiments of the invention, one or more examples of which are illustrated in the accompanying drawings. Each example is provided by way of explanation of the invention, not as a limitation of the invention. It will be apparent to those skilled in the art that various modifications and variations can be made in the present invention without departing from the scope or spirit of the invention. For example, features illustrated or described as part of one embodiment can be used in another embodiment to yield a still further embodiment. Thus, it is intended that the present invention covers such modifications and variations and come within the scope of the invention.

Embodiments of the invention provide a brassiere design in which one or more layers function independently of each other, while cooperating with one another to shape, lift and/or support a wearer's breasts. The layers may include, for example, but are not limited to, an interior support layer and an exterior support layer that are capable of moving independently from one another. Because the layers are independent from each other, they are able to move freely to give the wearer's breasts multiple layers and multiple areas of support. According to embodiments of the invention, no underwire for supporting the wearer's breasts is provided with the brassiere. For example, the wearer's breasts may be shaped by an interior support layer of the brassiere, lifted by interior support straps of the brassiere, and supported by an exterior support layer of the brassiere without employing an underwire for supporting the wearer's breasts.

Figure 2:
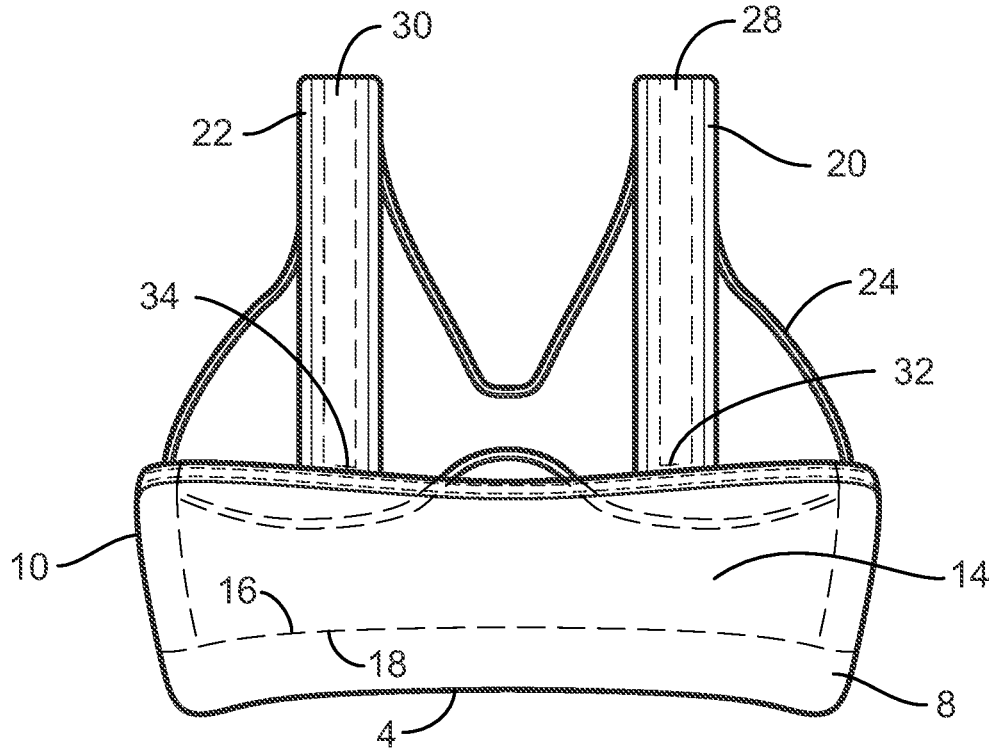
FIG. 2 illustrates a rear view of an example of the brassiere of FIG. 1 according to embodiments of the invention.
Figure 3:
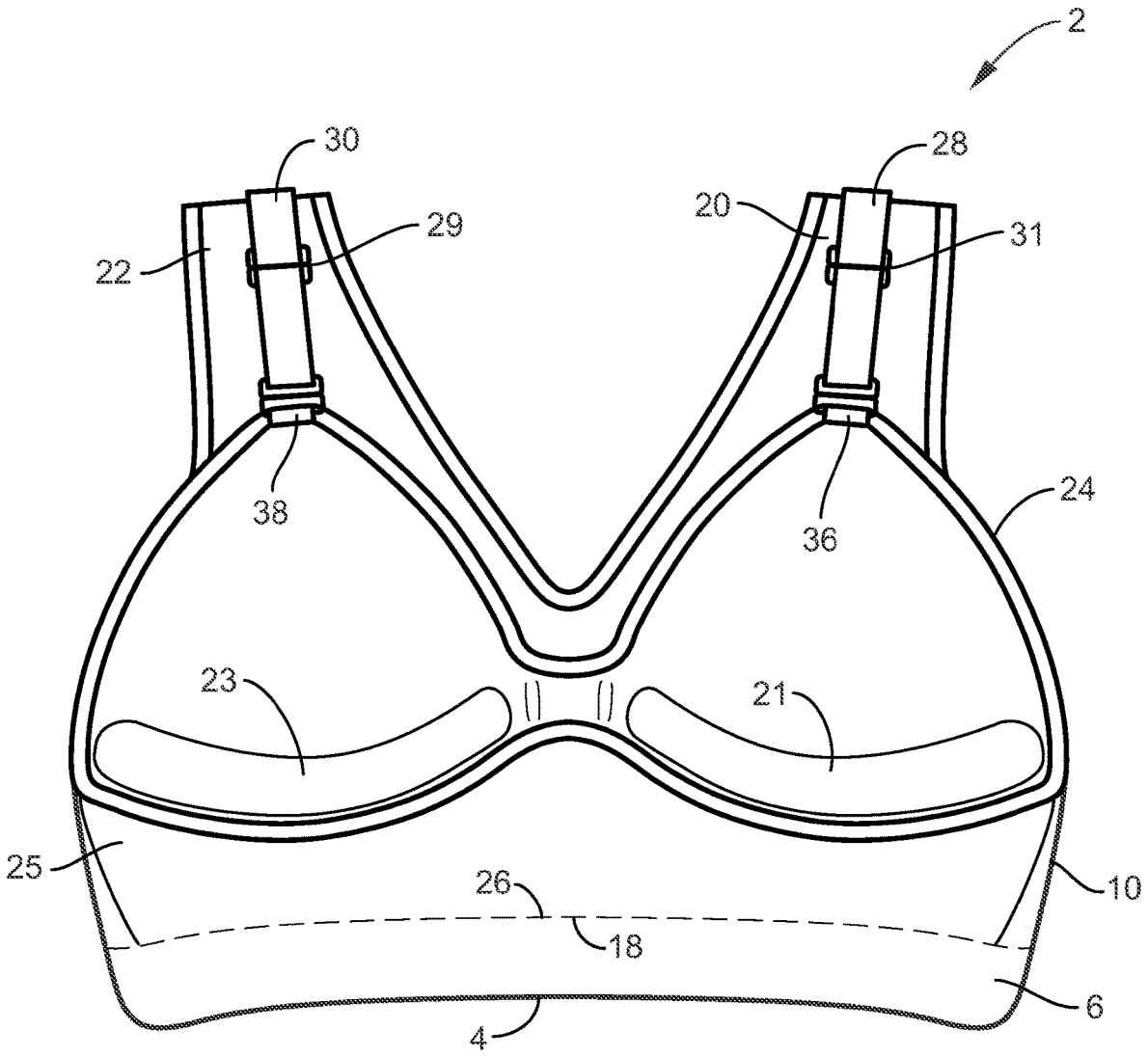
FIG. 3 illustrates a rear view laid flat and everted to show the inside of the interior support layer of an example of the brassiere of FIGS. 1 and 2 according to embodiments of the invention.

FIGS. 1-3 illustrate, respectively, a front view, a rear view, and the rear view laid flat and everted of an example of the brassiere according to embodiments of the invention. Referring to FIGS. 1-3, a brassiere 2 according to embodiments of the invention may include, for example, a support band 4 configured to at least partially or fully encircle a wearer's torso. For example, the support band 4 may have a support band front portion 6 as shown in FIG. 1 and a support band rear portion 8 as shown in FIG. 2. The support band 4 may be made, for example, of blended or knitted fabric, woven elastic, nylon, spandex, cotton, other suitable material, or combination thereof. The support band 4 may also be an extension of the exterior support layer 10.

Referring to FIGS. 1 and 2, the brassiere 2 for embodiments of the invention may also include, for example, an exterior support layer 10 configured to at least partially or fully encircle a wearer's torso. The exterior support layer 10 may have an exterior support layer front portion 12 as shown in FIG. 1 that is configured to be positioned generally along a front of the wearer's torso and an exterior support layer rear portion 14 as shown in FIG. 2. The exterior support layer rear portion 14 may be coupled to the exterior support layer front portion 12 at side areas of the brassiere 2. The exterior support layer bottom edge portions 16 may be coupled to the support band 4, such as at a top edge 18 of the support band 4. The shoulder straps 20, 22 may extend between the front portion 12 and rear portion 14 of the exterior support layer 10.

According to embodiments of the invention, the shoulder straps 20, 22 may be integrally formed with the exterior support layer 10, such as with the front portion 12 of the exterior support layer 10 and/or the rear portion 14 of the exterior support layer 10. According to embodiments of the invention, the shoulder straps 20, 22 may be attached to the exterior support layer 10, such as with the front portion 12 of the exterior support layer 10 and/or the rear portion 14 of the exterior support layer 10.

Referring to FIG. 3, the brassiere 2 according to embodiments of the invention may additionally include, for example, an interior support layer 24 configured to be positioned between the exterior support layer front portion 12 shown in FIGS. 1 and 2 and the front of the wearer's torso. The interior support layer 24 may be directly or indirectly attached to the support band front portion 6. According to an embodiment, the interior support layer 24 may have a bottom edge portion 26 coupled to the top edge 18 of support band front portions 6. Referring to FIGS. 2 and 3, in embodiments of the invention, interior support straps 28, 30 may be coupled to the exterior support layer rear portion 14 and the interior support layer 24, such as between respective top edge portions 32, 34 of the exterior support layer rear portion 14 as shown in FIG. 2 and respective top edge portions 36, 38 of the interior support layer 24 as shown in FIG. 3.

Thus, embodiments of the invention may provide an underwire-free brassiere 2 that may be characterized as a "wire-free comfort bra" with a built-in shaping, lifting, and/or support system. According to embodiments of the invention, the exterior support layer 10 and interior support layer 24, while independent of one another, may each be attached to at least a portion of the support band 4 and work together. According to embodiments of the invention, while the interior support straps 28, 30 may each be attached to a portion of each of the exterior support layer 10 and the interior support layer 24, the interior support straps 28, 30 may move freely with respect to the exterior support layer 10 and the interior support layer 24 to function independently of the exterior support layer 10 and the interior support layer 24. Consequently, each component may perform different functions to provide multiple levels of shaping, lift, and support of a wearer's breasts without a wire for supporting the wearer's breasts. According to embodiments of the invention, optional push-up bumps 21, 23 may be molded into the bottom portion of the foam of the interior support layer 24 as shown in FIG. 3.

When the exterior support layer 10 and interior support layer 24 of the brassiere 2 according to embodiments of the invention are independent from one another, they are able to move freely with respect to one another to give a wearer's breasts multiple layers and areas of support. For example, the wearer's breasts may be shaped by the interior support layer 24, lifted by the interior support straps 28, 30 and supported by the exterior support layer 10 without the need of a wire for supporting the wearer's breasts. According to embodiments of the invention, the interior support straps 28, 30 are attached to top edge portions 36, 38 of the interior support layer 24 and to the respective top edge portions 32, 34 of the exterior support layer rear portion 14, but the interior support straps 28, 30 function independently of the exterior support layer 10.

Figure 4:
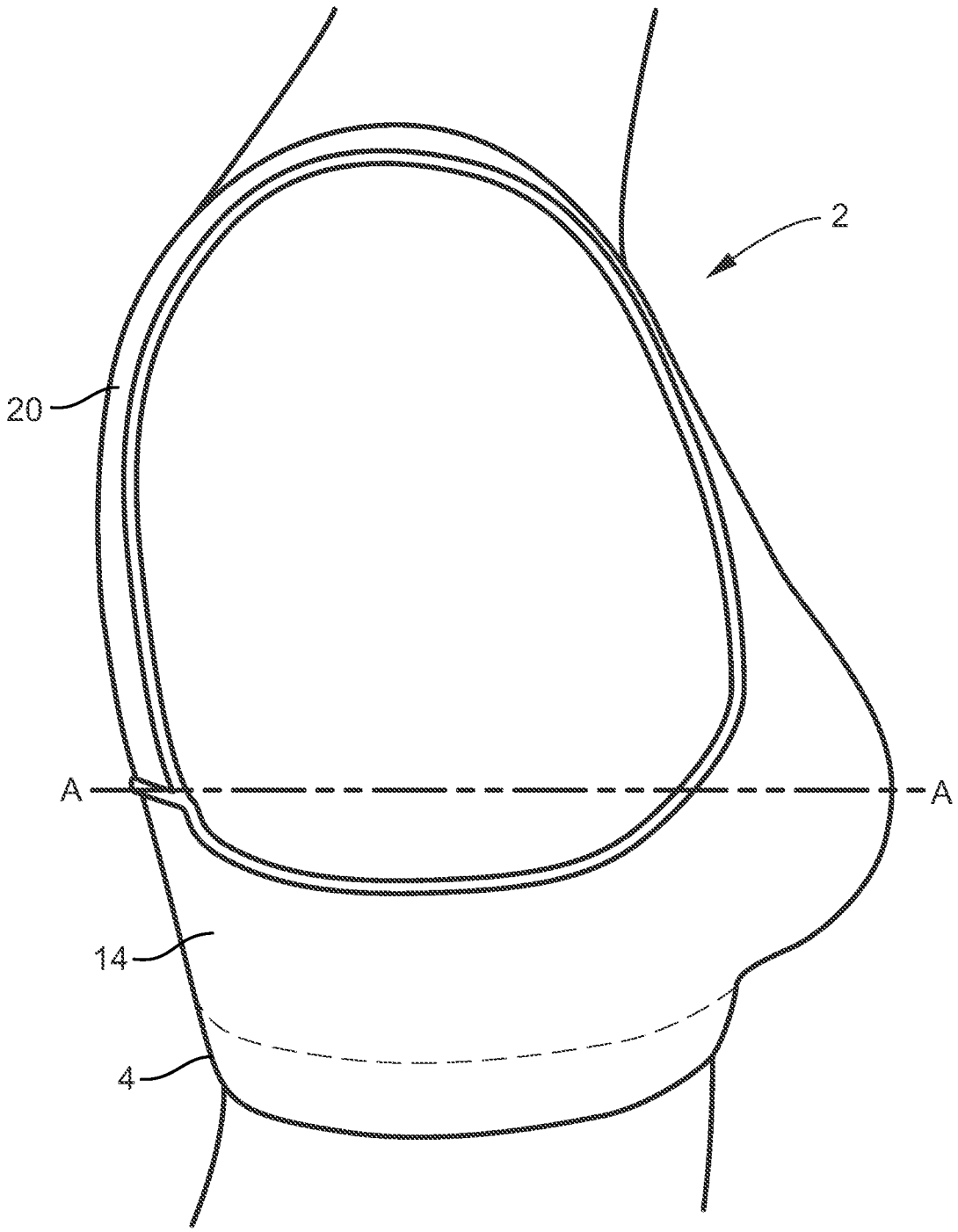
FIG. 4 illustrates an example of the brassiere shown in FIGS. 1-3 according to embodiments of the invention worn on a person in a side view.

FIG. 4 illustrates an example of the brassiere 2 for embodiments of the invention worn on a person in a side view. Referring to FIGS. 2-4, in the brassiere 2, having the interior support straps 28, 30 attached at respective top edge portions 32, 34 of the exterior support layer rear portion 14 shown in FIG. 2, the attachment locations of the interior support straps 28, 30 to the top edge portions 32, 34 of the exterior support layer rear portion 14 lie in substantially the same horizontal plane designated by line A-A shown in FIG. 4 as a wearer's breast, in order to evenly distribute the weight of the wearer's breast from front to back, resulting in an upright breast position without a wire for supporting the wearer's breasts. For example, the line A-A intersects at or near the apex of the brassiere 2 or the wearer's breasts, which may be at or near a midline of the wearer's breasts. Moreover, the attachment of each interior support strap 28, 30 at respective top edge portions 36, 38 of the interior support layer 24 shown in FIG. 3 disposed at or near the top center of each of a wearer's breasts provides optimal lift of the heaviest part of each breast.

Each of the components of a brassiere 2 according to embodiments of the invention may provide a number of significant benefits for a wearer. For example, the exterior support layer 10 holds in and supports the wearer's breasts, smoothes the wearer's back (e.g., maintains its shape, smoothes skin and minimizes back skin bulges), controls side "sleevage" (e.g., reduces or eliminates unsightly bulge between the brassiere and underarm), and provides all-day-long comfort for the wearer. For another example, the interior support layer 24 shapes and provides full support to the wearer's breasts, while also separating the wearer's breasts and eliminating the "uniboob" effect (i.e., the appearance of one massive breast) that is common with traditional wireless and comfort bras, and also provides modesty for the wearer.

Other components of the brassiere 2 for embodiments of the invention that provide significant benefits for a wearer may include, for example, the interior support straps 28, 30, which provide customizable and/or adjustable lift of the wearer's breasts, allowing a wearer with larger and/or heavier breasts to achieve the support of a wired bra without a wire for supporting the wearer's breasts. In addition, the interior support straps 28, 30 hold the wearer's breasts upright and eliminate a sagging or collapsing breast effect that is common with traditional wireless and comfort bras. In embodiments of the invention, lifting and holding of the wearer's breasts upright may be achieved by the interior support straps 28, 30, the interior support layer 24, the exterior support layer straps 20, 22, and the exterior support layer 10 working together.

Figure 5:
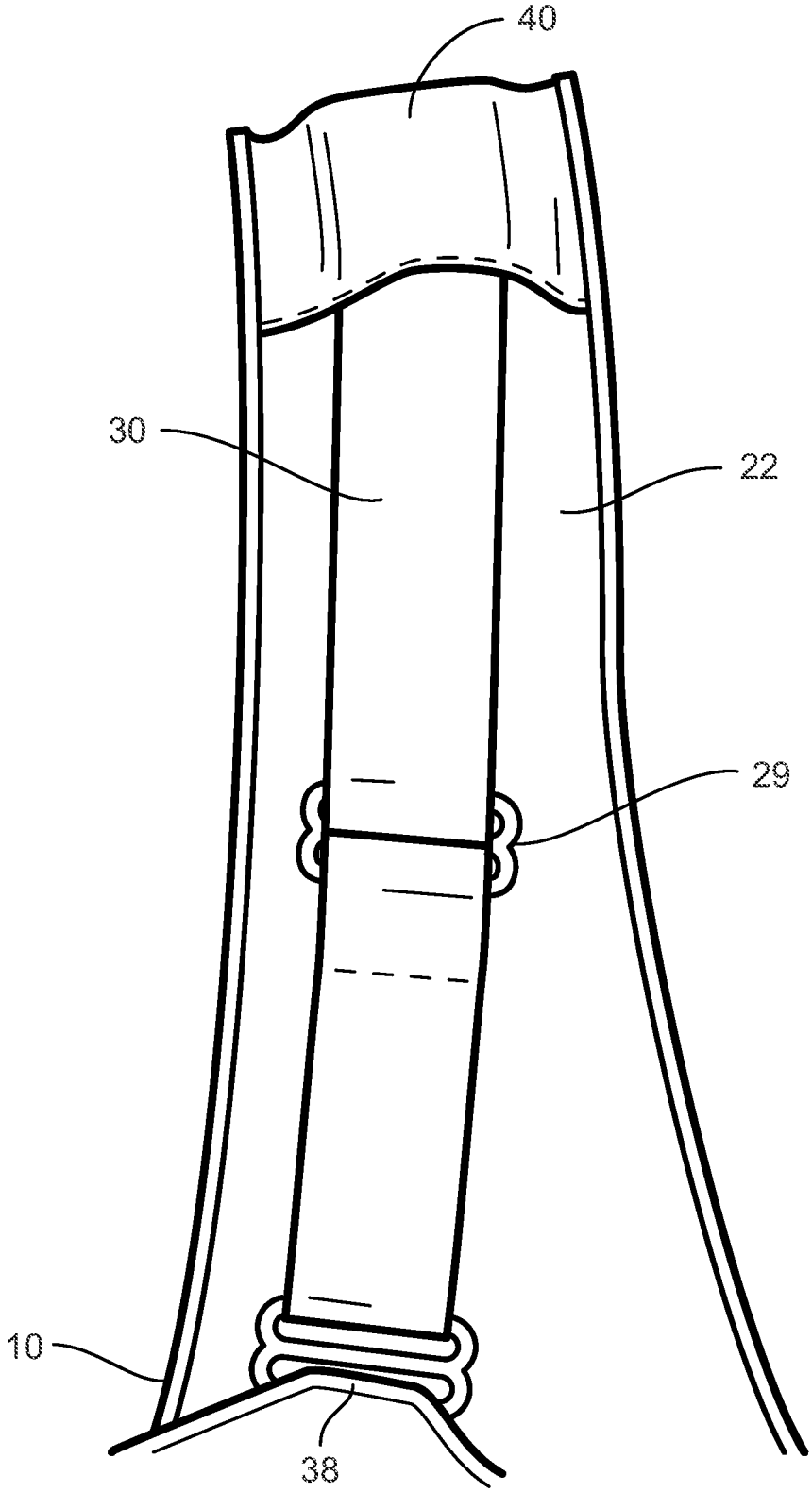
FIG. 5 illustrates a partial view showing one of the interior support straps and one of the exterior support straps of the example of the brassiere shown in FIGS. 1-4 according to embodiments of the invention.

FIG. 5 illustrates a partial view showing one of the interior support straps and one of the exterior support straps of the example of the brassiere 2 according to embodiments of the invention shown in FIG. 3. Referring to FIGS. 2, 3 and 5, the interior support straps 28, 30 may be at least partially or fully concealed, for example, within a channel 40. According to embodiments of the invention, channel 40 may be formed, for example, in or on each of exterior support layer shoulder straps 20, 22 of exterior support layer 10, which stabilizes the shoulder straps 20, 22 of the exterior support layer 10. According to embodiments of the invention, the interior support straps 28, 30 are not affixed to the channel 40. In embodiments of the invention, the edges of channel 40 may or may not be affixed, for example, by sewing, to exterior support layer shoulder strap 20, 22, but that movement of interior support straps 28, 30 through the tunnel created by channel 40 may not be impeded in any way. Thus, a bunching-up of strap material near the wearer's shoulders, which is a common occurrence with comfort bras with wide straps, is eliminated. Finally, the support band 4 may provide an additional layer of support for the wearer's breasts In embodiments of the invention, the exterior support layer 10 may comprise at least one or more layers of fabric of any suitable type and may optionally be molded. For example, cut and sew fabric may be molded, such as by heat or other molding methods, and/or seamlessly knitted fabric may be knitted with or used, to form concave or cup-shaped areas in the fabric. According to embodiments of the invention, the exterior support layer 10 may have an exterior support layer front portion 12 and an exterior support layer rear portion 14 coupled to the exterior support layer front portion 12 at side areas of the exterior support layer 10 and two exterior support layer shoulder straps 20, 22 extending between the front portion 12 and rear portion 14 of the exterior support layer 10.

According to embodiments of the invention, the exterior support layer 10 may optionally have a back closure member (not shown), such as a hook and eye closure, hook and loop fastener, or other type of attachment or closure mechanism, disposed, for example, in the exterior support layer rear portion 14. The exterior support layer 10 may have bottom edge portions 16 coupled to a top edge 18 of the support band 4 as shown in FIG. 2, and the exterior support layer 10 may be attached to support band 4 along a portion of the length of the support band 4 or along the entire length of the support band 4.

Referring again to FIG. 3, the interior support layer 24 may comprise any suitable type of fabric, molded or non-molded fabric, and/or molded or non-molded foam. For example, the interior support layer 24 may be made wholly or partly of fabric, such as woven, knitted, or blended fabric, spandex, nylon, or cotton and/or any type of foam, such as rubber, plastic, polyurethane, polystyrene or latex foam, or combinations thereof. In addition, portions of the interior support layer 24 may be customized into any desired shape, such as portions forming concave or cup-shaped areas (i.e., breast cups) to receive a wearer's breasts. Further, such customized shapes may include, for example, round, oval, triangular, demi, plunge, quarter, bandeau, push-up, and/or oblong shapes. It is to be understood that the interior support layer 24 may comprise multiple pieces, such as two separate molded cups, as opposed to a single piece.

According to embodiments of the invention, the interior support layer 24 as shown, for example, in FIG. 3, may have bottom edge portions 26 coupled to the top edge 18 of support band front portions 6. Additionally, according to embodiments of the invention, the exterior support layer 10 as shown, for example, in FIGS. 1 and 2, and the interior support layer 24 as shown, for example, in FIG. 3, are not directly connected to one another, but are each instead independently attached to respective portions of the support band 4 at their at their respective bottom edges 16 and 26. Because exterior support layer 10 and interior support layer 24 are not directly connected together, they are allowed to move freely with respect to one another, and as a result, are able to independently lift, shape and support a wearer's breasts as well as function cooperatively to create multiple areas of support for the wearer's breasts.

Referring to FIGS. 2, 3, and 5, the interior support straps 28, 30 attached to respective top edge portions 36, 38 of the interior support layer 24 and to respective top edge portions 32, 34 of the exterior support layer rear portion 14 may be lengthwise adjustable, and may function to lift the interior support layer 24. Such lengthwise adjustment may be performed via respective strap adjusters 29, 31 shown in FIGS. 3 and 5, such as traditional slide type adjusters or other type of adjustment mechanism. According to an embodiment, as shown in FIG. 5, the interior support straps 28, 30 may optionally be partially concealed within a channel 40 formed on the exterior support layer 10 for optimal aesthetic appearance. Whether or not concealed in such manner within the channel 40 formed on the exterior support layer 10, the adjustable interior support straps 28, 30 may move freely within, and function independently of, the exterior support layer 10.

Referring to FIGS. 1-4, the support band 4 may be located, for example, at the base of the brassiere 2 below the breasts of a wearer and may be connected to at least a portion of the exterior support layer 10 and to at least a portion of the interior support layer 24. The support band 4 may be made of a material independent of the exterior support layer fabric, such as elastic, or may be an extension of the exterior support layer fabric. The brassiere 2 according to embodiments of the invention provides even distribution of the weight of a wearer's breasts. According to embodiments of the invention, the interior support straps 28, 30 may be attached to respective top edge portions 36, 38 of the interior support layer 24 as shown in FIG. 3, but may also be attached at respective top edge portions 32, 34 of the exterior support layer rear portion 14 as shown in FIG. 2.

According to embodiments of the invention, the attachments of the interior support straps 28, 30 to respective top edge portions 32, 34 of the exterior support layer rear portion 14 may be configured so that the attachments between the interior support straps 28, 30 and the exterior support layer rear portion 14 lie in substantially the same horizontal plane as a midline of a wearer's breasts as shown in FIG. 4. For example, this configuration may be important to evenly distribute the weight of the wearer's breasts from front to rear, resulting in an upright position of the wearer's breasts without a wire for supporting the wearer's breasts. In contrast, if the attachments of the interior support straps 28, 30 were positioned, for example, at a higher level along the shoulder straps 20, 22, the weight distribution of the wearer's breasts would be uneven, and as a result would force the breasts downwardly.

According to embodiments of the invention, the interior support layer 24 of a brassiere 2 may have bottom edge portions 26 coupled to the top edge 18 of support band front portions 6 as shown in FIG. 3. Bottom edge portions 26 of the interior support layer 24 may be connected directly to the top edge 18 of the support band front portions 6. According to embodiments of the invention, the bottom edge portions 26 of the interior support layer 24 may be connected indirectly to the top edge 18 of the support band front portions 6 via additional material 25 that extends from the bottom edge portions 26 of the interior support layer 24 to the top edge 18 of the support band front portions 6.

According to embodiments of the invention, referring to FIG. 1, the exterior support layer 10 of the brassiere 2 according to embodiments of the invention may have at least one layer of fabric of any suitable type and may optionally be molded. Referring to FIG. 1, the fabric of the exterior support layer 10 may be molded using heat molding or other molding method to create cup-like shapes in the fabric that are configured to receive a wearer's breasts.

Figure 6:
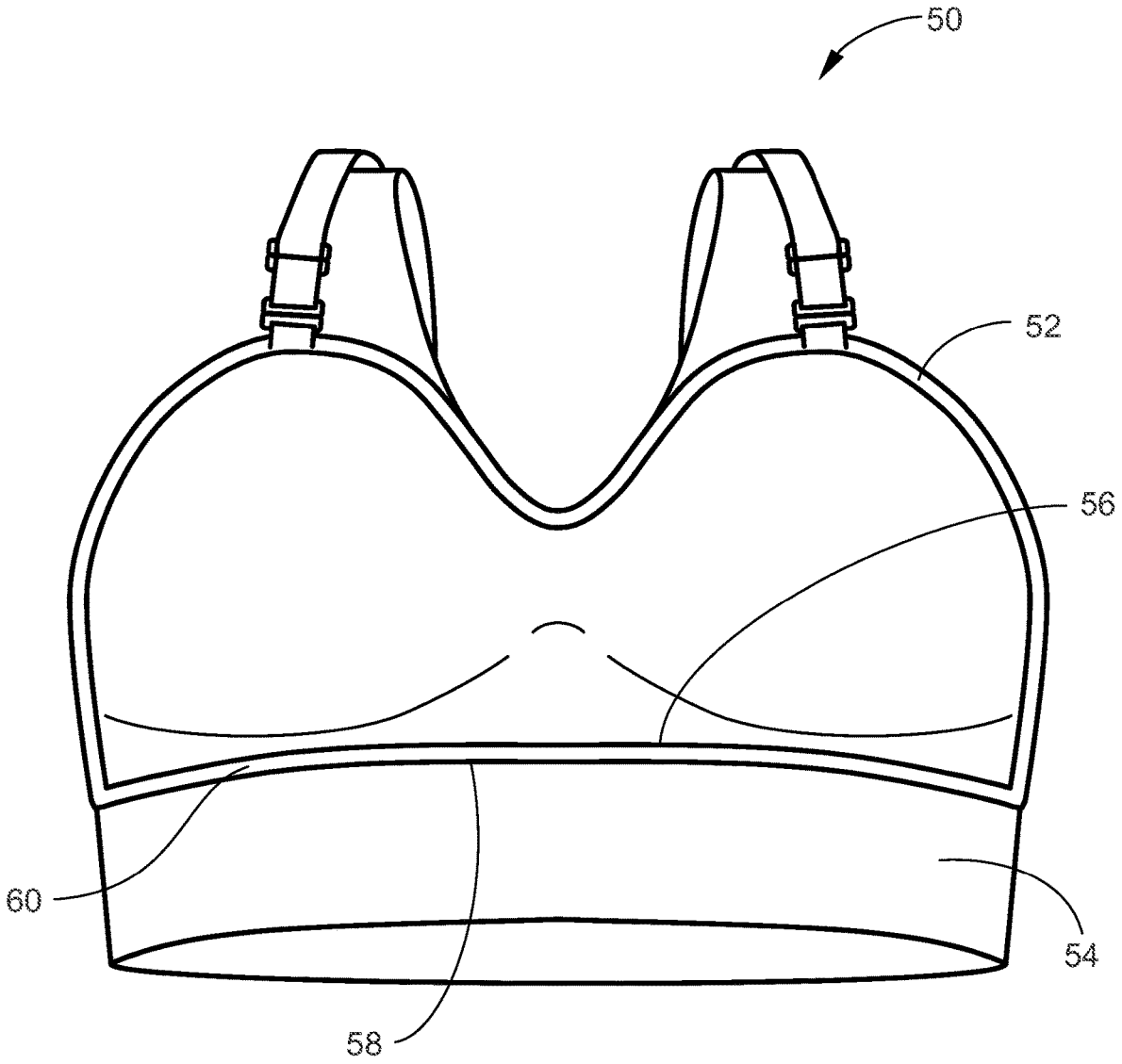
FIG. 6 illustrates a rear view laid flat and everted to show the inside of an interior support layer of an example of a brassiere according to alternative embodiments of the invention.

FIG. 6 illustrates a rear view laid flat and everted to show the inside of the interior support layer 52 of an example of a brassiere 50 in which the interior support layer 52 may be coupled to the support band front portion 54 according to alternative embodiments of the invention. Referring to FIG. 6, in such alternative embodiments, the bottom edge portions 56 of the interior support layer 52 may be coupled to the top edge 58 of the support band front portions 54 via additional material 60 that may extend from the bottom edge portions 56 of the interior support layer 52 to the top edge 58 of the support band front portions 54.

Embodiments of the invention may achieve maximum lift and support of the wearer's breasts without an underwire and hold the wearer's breast upright. Thus, embodiments of the invention may eliminate collapsing or flattening of the breasts without requiring the structure of a wire. In order for a traditional brassiere having multiple components connected together as a single unit to work properly, it is necessary for a wearer to wear the band of the brassiere very snugly. In such traditional brassieres, the brassiere bears a majority of the weight of the wearer's breasts in order to support the wearer's breasts.

Embodiments of the invention eliminate the need for the brassiere band to carry the majority of the weight of the breasts, because the interior layer, interior straps and the exterior layer all work together, lifting the weight from the band and distributing the weight among the independent layers and components of embodiments of the invention. This allows the wearer's breasts to be lifted from the front of the wearer's body. As a result, brassieres according to embodiments of the invention do not require an uncomfortably snug and constricting band for support of the wearer's breasts.

Additionally, because a traditional brassiere functions as single unit, when one problem arises, other problems typically arise as well. For example, when a band of a traditional brassiere is too loose on a wearer's body, the weight of the wearer's breasts may typically force the brassiere band upwardly on the wearer's back and at the same time allow the wearer's breasts to sag, resulting in discomfort of the wearer's breasts. This may cause an unsightly appearance as well as cause irritation of the wearer's skin as a result of the brassiere moving against the wearer's skin. In addition, when the wearer's breasts are forced downwardly, the shoulder straps of the brassiere may bear down on the wearer's shoulder causing further discomfort.

On the other hand, when the band of a traditional bra is snug on the wearer's body, which is essential for proper fit, the band may dig into fleshy skin areas of the wearer's body, causing discomfort, irritation and redness as well as unsightly skin budges on the wearer's body which may visible on the exterior of the wearer's clothing. It is self-apparent that such traditional brassieres, which are constructed and function as a single unit, cannot address the many needs of a wearer's breasts because the wearer's breasts have different needs that must be addressed individually. Embodiments of the invention overcome these limitations of traditional brassieres and provide improved brassieres having multiple layers that function independently of each other, yet work together to shape, lift and support a wearer's breasts.

Figure 7A:
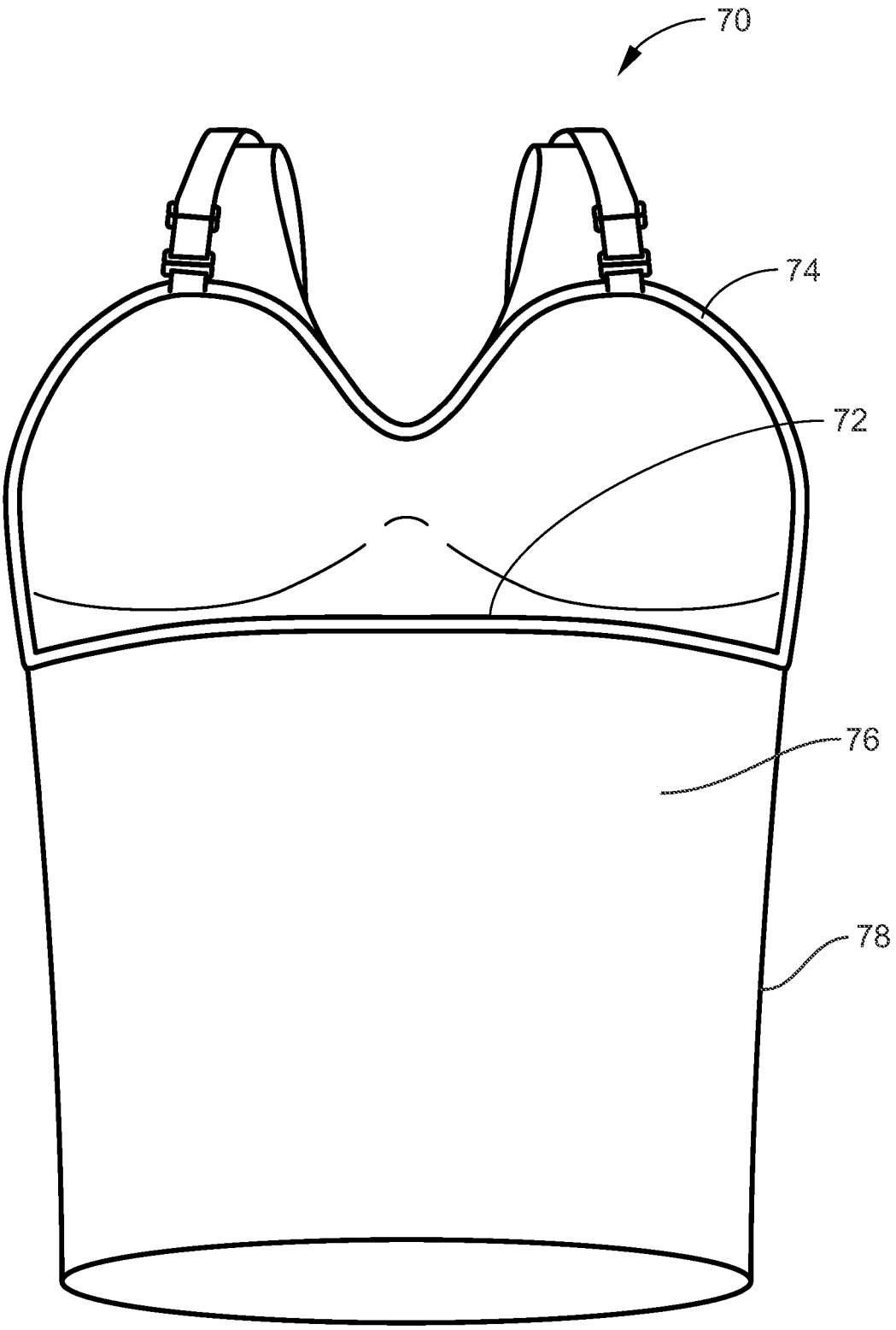
FIGS. 7A, 7B, and 7C illustrate a rear view everted to show an inside of interior and exterior support layers, a front view, and a rear view, respectively, of a brassiere according to a further alternative embodiment of the invention.
Figure 7B:
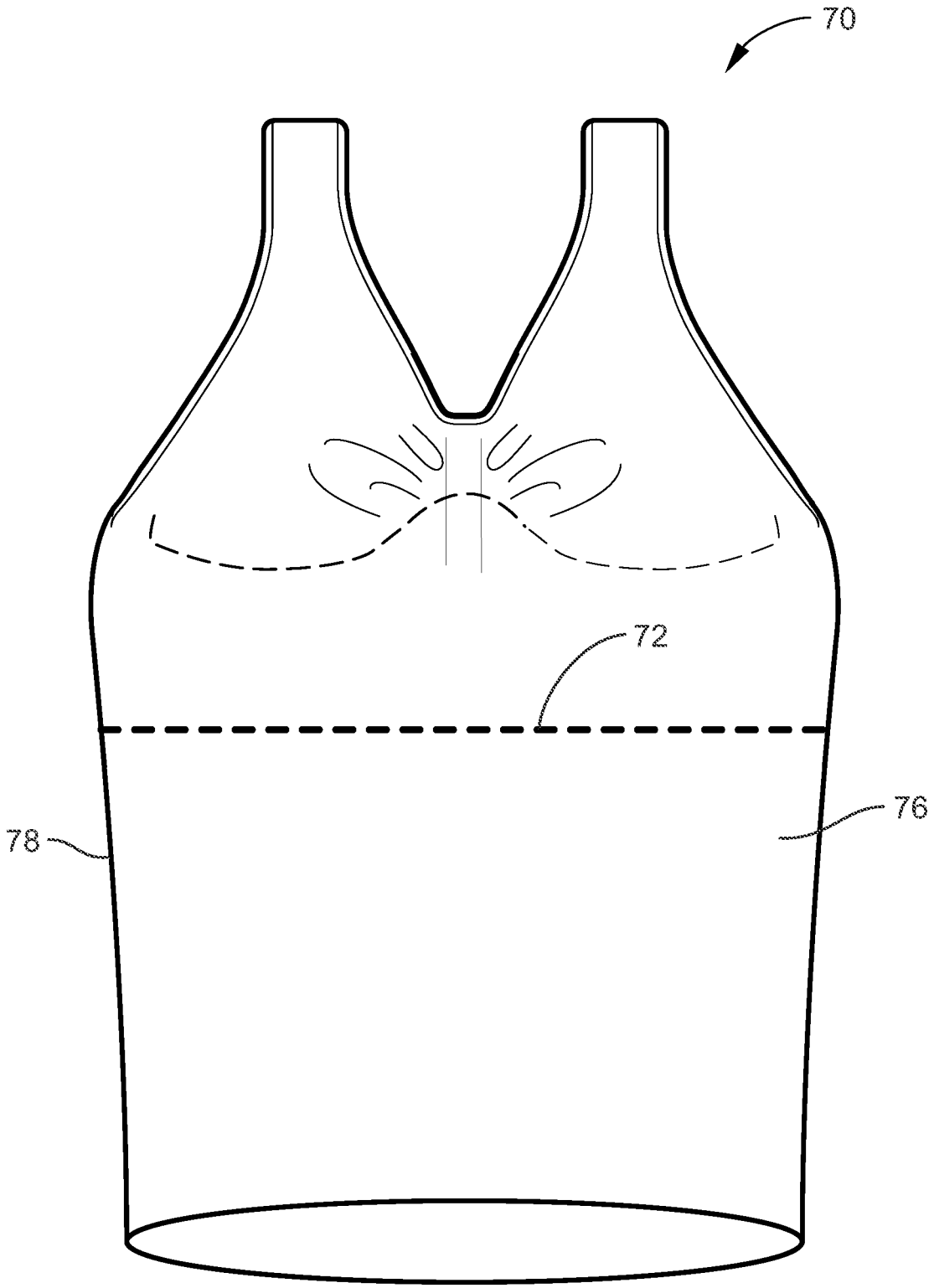
Figure 7C:
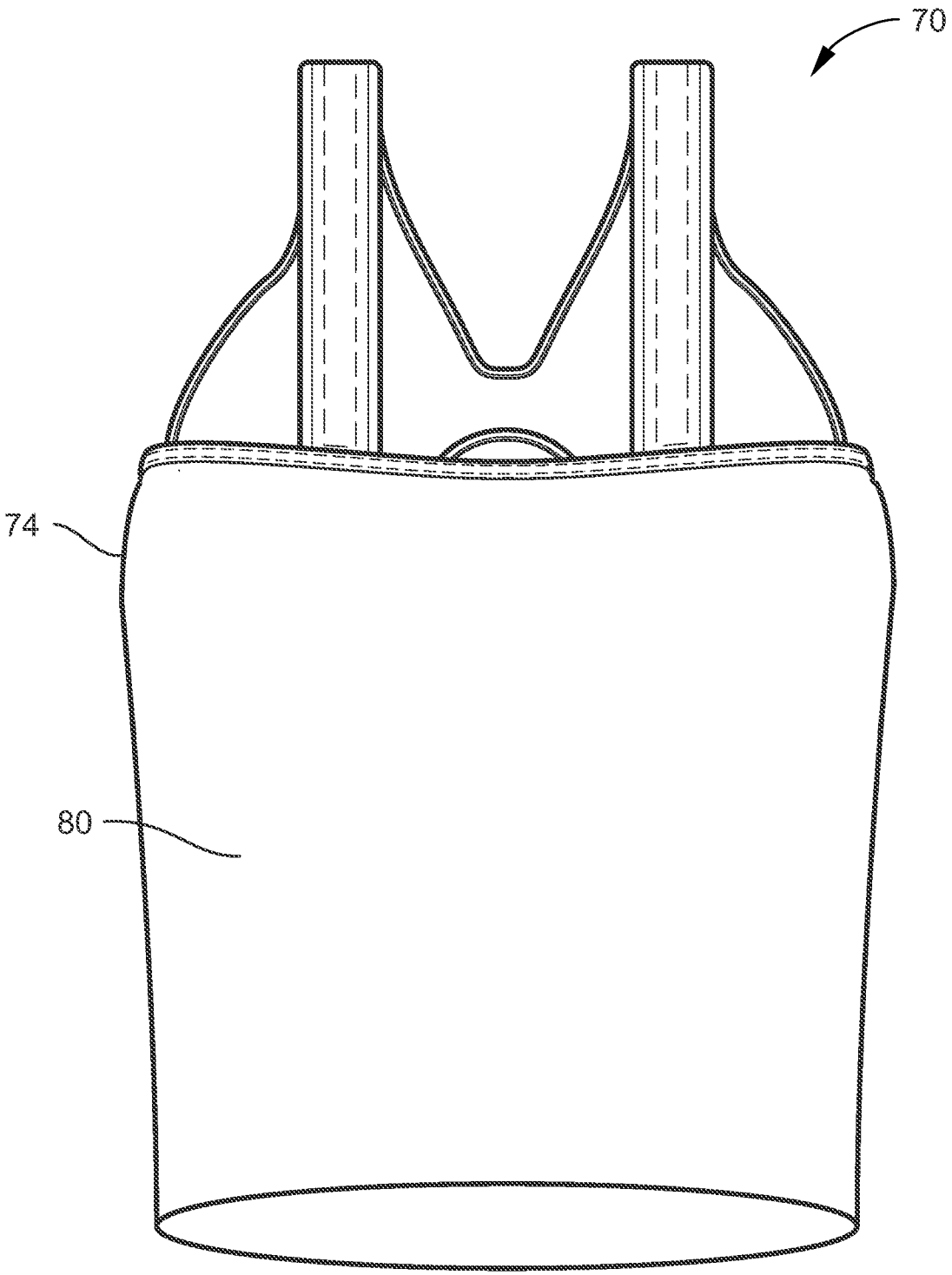

FIGS. 7A, 7B, and 7C illustrate a rear view everted to show respectively an inside of interior and exterior support layers 74, 78, a front view, and a rear view of a brassiere 70 according to a further alternative embodiment of the invention. Referring to FIGS. 7A, 7B, and 7C, the further alternative embodiment, the bottom edge portions of the interior support layer of brassiere may not be coupled to the top edge of the support band, but the interior support layer 74 may instead be to coupled, for example, to the front portion 76 of exterior support layer 78. In addition, front portion 76 of the exterior support layer 78 and the rear portion 80 of the exterior support layer 78 may, for example, extend downwardly a distance that is sufficient, for example, to at least partially cover upper body and torso portions of a wearer of the brassiere 70 and to reach a level proximate a level of the hips of the wearer.

Figure 8A:
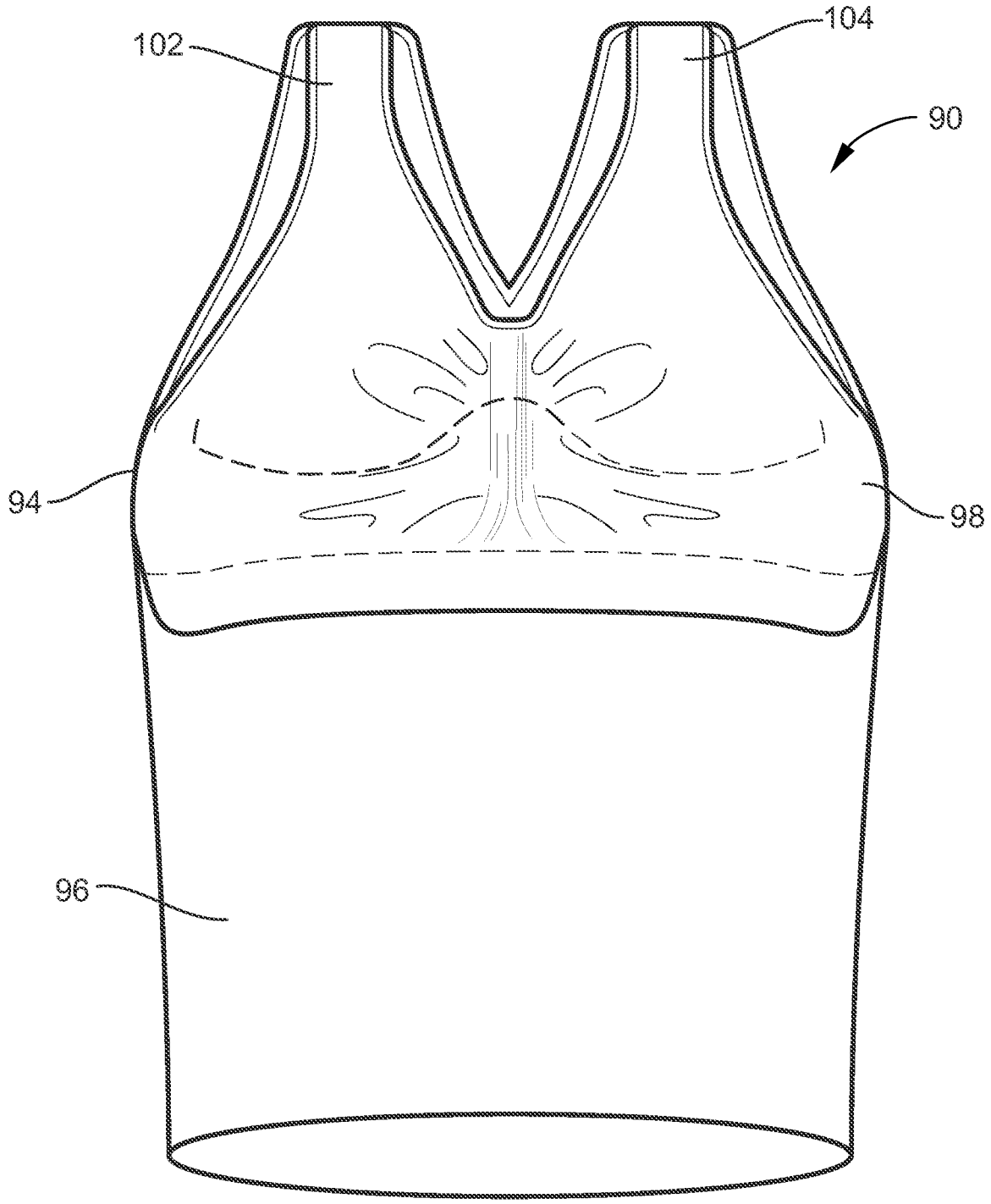
FIGS. 8A and 8B illustrate a front view and a rear view, respectively, of a brassiere according to a still further alternative embodiment of the invention.
Figure 8B:
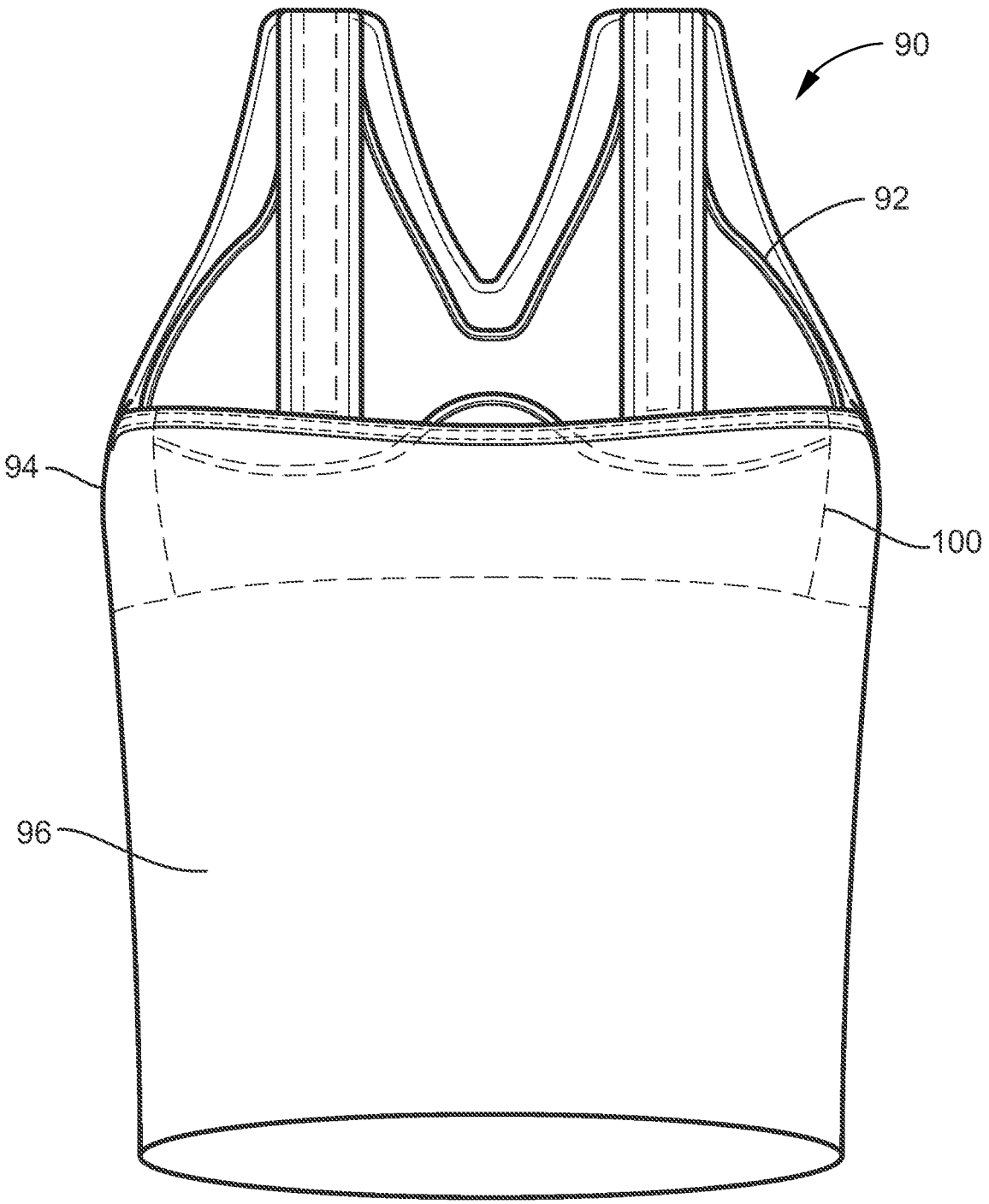

FIGS. 8A and 8B illustrate a front view and a rear view of a brassiere 90 according to a still further alternative embodiment of the invention. Referring to FIGS. 8A and 8B, in addition to interior support layer 92 and exterior support layer 94, brassiere 90 may include, for example, an additional layer 96 that at least partially covers the entire brassiere 90. The additional layer 96 may cover, for example, the front portion 98 of the exterior support layer 94, the rear portion 100 of the exterior support layer 94, and the shoulder straps 102, 104 of the brassiere 90 and may, for example, extend downwardly a distance that is sufficient, for example, to at least partially cover upper body and torso portions of a wearer of the brassiere 90 and to reach a level proximate a level of the hips of the wearer.

Use of language such as "at least one of X, Y, and Z," "at least one of X, Y, or Z," "at least one or more of X, Y, and Z," "at least one or more of X, Y, or Z," "at least one or more of X, Y, and/or Z," or "at least one of X, Y, and/or Z," are intended to be inclusive of both a single item (e.g., just X, or just Y, or just Z) and multiple items (e.g., {X and Y}, {X and Z}, {Y and Z}, or {X, Y, and Z}). The phrase "at least one of" and similar phrases are not intended to convey a requirement that each possible item must be present, although each possible item may be present.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. For example, it will be understood that embodiments of the invention may be made from a variety of different materials.

What is claimed is:

1. A brassiere comprising:

a brassiere support band having a support band front portion configured to be positioned at a front of a torso of a wearer and a support band rear portion configured to be positioned at a back of the torso;

an exterior support layer having an exterior support layer front portion configured to be positioned at the front of the torso and an exterior support layer rear portion configured to be positioned at the back of the torso, wherein the exterior support layer comprises an exterior support layer lower edge portion connected to the support band, and an exterior support layer shoulder strap extending between the exterior support layer rear portion and the exterior support layer front portion;

an interior support layer configured to be positioned between the exterior support layer front portion and the torso of the wearer, wherein the interior support layer comprises an interior support layer lower edge portion connected to the support band front portion; and an interior support layer shoulder strap extending between an upper edge portion of the exterior support layer rear portion and an upper edge portion of the interior support layer.

2. The brassiere of claim 1, wherein the support band comprises an elastic material.

3. The brassiere of claim 1, wherein the brassiere does not have an underwire for supporting the wearer's breasts.

4. The brassiere of claim 1, wherein the exterior support layer front portion comprises a material having portions forming two concave areas.

5. The brassiere of claim 1, wherein the exterior support layer front portion comprises a material having portions forming two cup-shaped areas.

6. The brassiere of claim 1, wherein the exterior support layer rear portion comprises a back closure.

7. The brassiere of claim 1, wherein the exterior support layer lower edge portion is connected to an upper edge portion of the support band.

8. The brassiere of claim 1, wherein an entire length of a lower edge of the exterior support layer is connected to an entire length of an upper edge of the support band.

9. The brassiere of claim 1, wherein the interior support layer comprises a material having portions forming two concave areas.

10. The brassiere of claim 1, wherein the interior support layer comprises a fabric material having portions forming two cup-shaped areas.

11. The brassiere of claim 9, wherein the interior support layer comprises a molded material having portions forming the two concave areas.

12. The brassiere of claim 11, wherein the interior support layer comprises the molded material having portions forming the two concave areas disposed adjacent two concave areas formed in a material of the exterior support layer front portion.

13. The brassiere of claim 11, wherein the interior support layer comprises the molded material having portions forming two breast cups disposed adjacent the two concave areas formed in a material of the exterior support layer front portion.

14. The brassiere of claim 1, wherein the interior support layer lower edge portion is connected to the support band front portion and the exterior support layer lower edge portion is connected to the support band independently of one another and independently movable relative to one another.

15. The brassiere of claim 1, wherein the interior support layer shoulder straps comprise interior support layer shoulder straps having adjustable lengths.

16. The brassiere of claim 1, wherein the interior support layer shoulder straps are independently moveable relative to the exterior support layer.

17. The brassiere of claim 1, wherein the interior support layer shoulder straps are at least partly concealed within channels formed on the exterior support layer shoulder strap.

18. The brassiere of claim 1, wherein the interior support layer shoulder strap is configured to be connected to the upper edge portion of the exterior support layer rear portion at a position lying in a same horizontal plane as a midline of breasts of the wearer.

19. A method of making a brassiere comprising:

providing a support band configured to at least partially encircle a torso of a wearer, said support band having a support band front portion configured to be positioned along a front of the torso and a support band rear portion configured to be positioned along a back of the torso;

attaching an exterior support layer to the support band at a lower edge portion of the exterior support layer, said exterior support layer being configured to at least partially encircle the torso and having an exterior support layer front portion configured to be positioned at a front of the torso and an exterior support layer rear portion configured to be positioned at a back of the torso, and exterior support layer shoulder straps extending between the exterior support layer rear portion and the exterior support layer front portion;

attaching an interior support layer at a lower edge portion of the interior support layer to the support band front portion, said interior support layer being configured to be positioned between the exterior support layer front portion and the front of the torso of the wearer; and connecting an interior support layer shoulder strap between an upper edge portion of the exterior support layer rear portion and an upper edge portion of the interior support layer.

20. The method of claim 19, further comprising:

attaching the exterior support layer to the support band at the lower edge portion of the exterior support layer; and attaching the interior support layer at the lower edge portion of the interior support layer to the support band front portion, wherein the exterior support layer and the interior support layer are attached independently of one another and are independently movable relative to one another.

21. The method of claim 19, further comprising:

connecting the interior support layer shoulder strap between the upper edge portion of the exterior support layer rear portion and the upper edge portion of the interior support layer, wherein the interior support layer shoulder strap has an adjustable length.

22. The method of claim 19, further comprising:

connecting the interior support layer shoulder strap between the upper edge portion of the exterior support layer rear portion and the upper edge portion of the interior support layer, wherein the interior support layer is independently moveable relative to the exterior support layer.

23. The method of claim 19, further comprising:

connecting the interior support layer shoulder strap between the upper edge portion of the exterior support layer rear portion and the upper edge portion of the interior support layer at least partly concealed within a channel formed on the exterior support layer shoulder strap.

24. The method of claim 19, further comprising:

connecting the interior support layer shoulder strap between the upper edge portion of the interior support layer and the upper edge portion of the exterior support layer rear portion at a location on the upper edge portion of the interior support layer and the upper edge portion of the exterior support layer rear portion configured to be lying in a same horizontal plane as a midline of respective breasts of the torso of the wearer.

25. A method of adjusting a brassiere, said brassiere comprising a support band, an exterior support layer having a lower edge portion of the exterior support layer connected to the support band and an exterior support layer shoulder strap extending between a rear portion of the exterior support layer and a front portion of the exterior support layer, the front portion of the exterior support layer having portions forming two concave areas, an interior support layer having portions defining two breast cups and configured to be positioned between the front portion of the exterior support layer and the front of the torso of the wearer, a lower edge portion of the interior support layer being connected to the support band, and an interior support layer shoulder strap having an adjustable length extending between the interior support layer and the rear portion of the exterior support layer and independently moveable relative to the exterior support layer, comprising the steps of:

placing said brassiere on the torso of a wearer with the wearer's breasts received within the two breast cups defined by said portions of the interior support layer; and altering a tension of the interior support layer shoulder strap on said wearer by adjusting a length of said interior support layer shoulder strap independently of said exterior support layer.

* * * * *